United States Patent [19]

Cole

[11] 4,089,656

[45] May 16, 1978

[54] TREATMENT OF SOLID FUELS

[75] Inventor: Edward L. Cole, Fishkill, N.Y.

[73] Assignee: Texaco Inc., New York, N.Y.

[21] Appl. No.: 716,499

[22] Filed: Aug. 23, 1976

[51] Int. Cl.[2] ..... C10L 9/10

[52] U.S. Cl. ..... 44/1 R; 44/1 G

[58] Field of Search ..... 44/1 R, 1 A, 1 G, 1 C, 44/10 F

[56] References Cited

U.S. PATENT DOCUMENTS

| | | | |
|---|---|---|---|
| 1,153,182 | 9/1915 | Schniewind | 44/1 A |
| 2,726,148 | 12/1955 | McKinley et al. | 44/1 R |
| 3,252,769 | 5/1966 | Nagelvoort | 44/1 R |
| 4,018,571 | 4/1977 | Cole et al. | 44/1 R |

*Primary Examiner*—Carl F. Dees

*Attorney, Agent, or Firm*—Thomas H. Whaley; Carl G. Ries; Robert Knox, Jr.

[57] ABSTRACT

Solid fuels which yield low $SO_2$ emission on combustion are produced by a process which comprises separating the solid fuel into a light portion having a specific gravity of about 1.6 or less and a heavy portion and subjecting the light portion to hydrothermal treatment.

9 Claims, No Drawings

TREATMENT OF SOLID FUELS

This invention relates to the treatment of solid fuels. More particularly, it is concerned with the reduction of the amount of pollutants emitted by sulfur-containing coals on the combustion thereof.

For the protection of the environment, the burning of coal is currently restricted to the extent that $SO_2$ emissions are not permitted to exceed 1.2 pounds per million BTU. Although some high grade coals meet this requirement, many low rank coals such as sub-bituminous coal and lignite found in the western states of Wyoming, Montana, Colorado and Utah even although they have relatively low sulfur contents do not meet this requirement because of their low BTU value.

It has already been proposed to reduce the sulfur content of coal by chemical means, such as by contacting the coal with an oxidizing agent, for example, a peroxide, peracid or hypochlorite. However, these methods have not proven to be very satisfactory.

It is, therefore, an object of this invention to upgrade low rank solid fuels e.g. sub-bituminous coals and lignite. Another object is to reduce the sulfur content of the solid fuel. Still another object is to reduce the amount of $SO_2$ emission per million BTU when the coal is subjected to combustion. These and other objects will be obvious to those skilled in the art from the following disclosure.

According to my invention, the amount of $SO_2$ emission on the combustion of low rank solid fuel is reduced by subjecting the solid fuel to a treatment which comprises separating the fuel into a portion having a specific gravity of about 1.6 or less and a portion having a specific gravity above about 1.6 and subjecting the lighter portion to hydrothermal treatment.

The solid fuels or coals to which the process of my invention may be applied are sub-bituminous coals and lignite, but the invention is not restricted thereto. Low rank fuels from other sources may be used as feed to my novel process. In this specification and the appended claims, the terms coal and solid fuel are used interchangeably and unless otherwise specified are intended to mean sub-bituminous coals and/or lignite.

For the separation of the solid fuel into portions of different specific gravity, the fuel should first be ground to a suitable size which will depend on the type of coal, its source and the hydrothermal treating conditions, such as the time and temperature of the treating step. Ordinarily, the coal is ground to a size having a maximum cross-sectional dimension of less than 1 inch and preferably, less than ½ inch and still more preferably, less than ¼ inch. By means of the sink-float technique, coal is brought into contact with a liquid having the desired specific gravity. That material having a specific gravity of 1.6 or less will float on the surface of the liquid and that material heavier or having a specific gravity above 1.6 will sink.

The liquid used in the separation bath may comprise an organic liquid or a solution of an inorganic compound, such as zinc chloride or calcium chloride in water. However, these water solutions are unsatisfactory as the solution tends to be absorbed in the pores of the coal and in addition, they tend to become viscous and interfere with the separation process. Preferred liquids comprise halogenated hydrocarbons, such as tetrachloroethylene or Certigrav, a mixture of halogenated solvents. Suspensions may also be used.

The solid fuel having a specific gravity of 1.6 or less which has been separated by flotation is then washed and subjected to a hydrothermal treatment which, as the name implies, is treatment with hot water. The hydrothermal treatment of the solid fuel should be carried out under nonoxidizing conditions and, therefore, air or other free oxygen containing gas should be removed from the treating zone. This may be done prior to introduction of the coal and water into the hydrothermal zone by sweeping it with a gas containing no free oxygen such as reducing gas, hydrogen, steam or nitrogen and introducing the coal and water into the treating zone under a blanket of the gas. Alternatively, the coal and water may be charged to the treating zone after which the non-oxidizing sweep is made to provide the desired atmosphere.

After the free oxygen has been removed from the reaction zone, it is preferably pressured with a nonoxidizing gas, such as reducing gas, flue gas, steam, nitrogen or hydrogen and then heated to a temperature between about 300° and 590° F., preferably from 400° to 550° F. The pressure in the reaction zone should be such that at least a substantial portion and preferably all of the water in the reaction zone remains in the liquid state. In a preferred embodiment, the hydrothermal zone is swept with nitrogen then pressured to between about 50 and 100 psig with nitrogen and heated to the desired temperature under autogenous pressure. Generally, the pressure will not exceed about 2,000 psig.

The time at temperature may range from one minute to five hours although a preferred range is from 5 minutes to 4 hours, one-half to 2 hours being still more preferred. Although some effect is obtained at shorter time intervals of less than 5 minutes, for practical reasons it is more desirable to maintain the solid fuel and water at the designated temperature for a period of at least 5 minutes.

In a more specific embodiment of my invention, the solid fuel is separated into three fractions, one having a specific gravity less than 1.4, one having a specific gravity from 1.4 to 1.6 and the other having a specific gravity above 1.6. The less than 1.4 material is subjected to hydrothermal treatment and the 1.4–1.6 material is subjected separately to hydrothermal treatment. The 1.4–1.6 specific gravity material yields a fuel of intermediate heating value and the less than 1.4 specific gravity material a fuel somewhat higher in heating value.

The following examples are submitted for illustrative purposes only and it should not be construed that the invention is restricted thereto.

EXAMPLE I

In this example the raw sub-bituminous coal is passed through a screen assembly where coal having a particle size of 1 inch × ¼ inch is separated from the finer and the coarser material. The coarser mterial is crushed and recycled to the screen assembly. A light water spray on the screens facilitates the separation. This procedure results in two portions, one having a particle size of less than ¼ inch and one having a particle size range of 1 inch × ¼ inch.

The 1 inch × ¼ inch fraction is passed to a dense media three-product separation zone containing suspended magnetite where a separation is made into three fractions; a light fraction having a specific gravity of less than 1.4, a middle fraction having a specific gravity ranging from 1.4 to 1.6, and a refuse fraction having a specific gravity greater than 1.6.

The data from the dense media separation is tabulated below.

TABLE 1

| Specific Gravity | Wt. % | Sulfur,% | Moisture,% | BTU/lb.* |
|---|---|---|---|---|
| Under 1.4 | 55.5 | 0.65 | 26.2 | 8040 |
| 1.4 to 1.6 | 19.6 | 1.61 | 21.9 | 5210 |
| Over 1.6 | 24.9 | 0.40 | 16.4 | 2125 |

*moisture free

The fraction having a specific gravity of less than 1.4 is washed free of magnetite and is then subjected to hydrothermal treatment with water in a nitrogen atmosphere at 500° F. and an autogenous pressure of 700 psig for 10 minutes. The water and gas are separated from the coal which is then dried to a moisture content of about 5 %. A coal yield representing 64.8% of the charge to the hydrothermal zone and 35.9% of the charge to the dense media separation zone is recovered.

The tests on the product are shown below.

TABLE 2

| | |
|---|---|
| Ash, wt. % | 10.8 |
| Sulfur, wt. % | 0.52 |
| Moisture, wt. % | 5.0 |
| BTU/lb.* | 10,500 |

*moisture free

The current Federal Air Quality Standard for $SO_2$ emission from a new stationary source is 1.2 pounds per million BTU heat input when solid fuel is burned. Calculation from the sulfur content and the BTU value of the hydrothermally-treated sample shows that 0.99 pounds of $SO_2$ will be emitted per million BTU as compared to 1.62 pounds of $SO_2$ emitted from the charge to the hydrothermal treating zone.

EXAMPLE II

The 1 inch × ¼ inch material having a specific gravity of from 1.4 to 1.6 from Example I after being washed free of magnetite is crushed to a size of less than ¼ inch and combined with that material less than ¼ inch from the initial grinding of Example I. The product is passed over a sieve bend to remove slimes and a screen to remove fines. The sieve bend bar spacing is set at 1 mm to effectively remove materials less than about ½ mm. The oversize is next passed over a vibrating screen where water sprays assist in removing the remaining material less than ½ mm in size. The coal is then processed through a heavy media cyclone to yield a refuse and a clean coal which latter is washed.

This clean coal is subjected to hydrothermal treatment with water in the liquid phase in a nitrogen atmosphere at a temperature of 550° F. and an autogenous pressure of 1050 psi. The resulting product after drying to a 5 % moisture content has an ash content of 15.2 weight %, a sulfur content of 0.54 weight %, and a BTU per pound value of 8970 and is within the $SO_2$ emission tolerance of Federal regulations.

When using a magnetite suspension for the separation of coals according to my process, the density of the suspension may range from 1.35 to about 1.45 depending on the difficulty of separation of the product. The density of the suspension may be determined from the equation $$D = \frac{100}{(100 - C) + \frac{C}{d}}$$

Where

D = density of the suspension (g/cc)

d = density of the solids (g/cc)

and

C = concentration of solids (wt. %)

Magnetite has a specific gravity of 5.

EXAMPLE III

In this example, the charge is a sub-bituminous coal having a water content of 39 % but having the following characteristics on a moisture-free basis.

Table 3

| | |
|---|---|
| Carbon, % | 52.2 |
| Hydrogen, % | 4.0 |
| Nitrogen, % | 0.6 |
| Sulfur, % | 0.58 |
| Ash, % | 24.8 |
| Oxygen, (by difference) % | 17.8 |
| Heat of Combustion, Gross, BTU/lb. | 8874 |

The coal was screened using a Tyler 10 mesh sieve. That portion greater than 10 mesh was separated, using a Certigrav solution having a specific gravity (60°/60° F.) of 1.5 into a lighter float portion and a heavier sink portion, each of which was then washed with methanol, dried and ground to less than 60 mesh. Tests on the products are tabulated below:

TABLE 4

| | Sink | Float |
|---|---|---|
| Moisture, % | 4.6 | 8.2 |
| Carbon, % | 25.2 | 58.6 |
| Hydrogen, % | 2.0 | 4.5 |
| Nitrogen, % | 0.33 | 0.64 |
| Sulfur, % | 0.53 | 0.66 |
| Ash, % | 44.4 | 12.2 |
| Oxygen (difference), % | 22.94 | 15.1 |
| Heat of Combustion, Gross, BTU/lb. | 4166 | 10,116 |
| Lb. $SO_2$ emitted/million BTU | 2.55 | 1.48 |

Neither sample met the requirement of a maximum $SO_2$ emission of 1.2 lbs. per million BTU.

That portion from the initial screening having a size less than 10 mesh was air-dried and screened through a Tyler 48 mesh sieve. The 10–48 mesh material was subjected to a float-sink separation in a 1.5 specific gravity Certigrav solution. Both the float and sink portions were washed with methanol and then air dried to constant weight. Tests on each portion are tabulated below:

TABLE 5

| | Float | Sink |
|---|---|---|
| Moisture, % | 7.2 | 3.7 |
| Carbon, % | — | 26.3 |
| Hydrogen, % | — | 1.8 |
| Nitrogen, % | — | 0.3 |
| Sulfur, % | 0.6 | 0.46 |
| Ash, % | 16.3 | 50.3 |
| Oxygen (difference), % | — | 17.1 |
| Heat of Combustion, Gross, BTU/lb. | 9203 | 4229 |

The float material derived from both the 10–48 mesh portion and the greater than 10 mesh portion although enhanced in heating value, fail to meet the EPA requirement of a maximum of 1.2 lbs. of $SO_2$ emitted per million BTU.

46.7 parts by weight of the float material derived from the greater than 10 mesh coal and 29.6 parts by weight of the float material derived from the 10–48 mesh coal are composited and portions of the blend are subjected to hydrothermal treatment at 575° F. under autogenous pressure, one in an atmosphere of nitrogen and one in an atmosphere of hydrogen. Tests on the charge to the hydrothermal treatment and on the products are tabulated below:

TABLE 6

| | Charge | Nitrogen | Hydrogen |
|---|---|---|---|
| Sulfur, % | 0.68 | 0.63 | 0.60 |
| Heating value, BTU/lb. | 10475 | 11250 | 11250 |
| Lb. $SO_2$emitted/$10^6$ BTU | 1.30 | 1.12 | 1.07 |

These data show that hydrothermal treatment of the float portions produces a solid fuel well within EPA requirements.

Various modifications of the invention as hereinbefore set forth may be made without departing from the spirit and scope thereof, and therefore, only such limitations should be made as are indicated in the appended claims.

We claim:

1. A process for reducing the amount of $SO_2$ produced by the combustion of a low rank solid fuel which comprises separating said fuel into a first portion having a particle size smaller than a 10 mesh Tyler sieve and a second portion having a particle size greater than a 10 mesh Tyler sieve, separating said second portion into a third portion having a specific gravity below about 1.5 and a fourth portion having a specific gravity above about 1.5, grinding said third portion to a particle size smaller than 10 mesh Tyler sieve, screening said first portion to provide a 10–48 mesh Tyler sieve portion, combining said 10–48 mesh portion and said ground third portion and subjecting the resulting mixture to hydrothermal treatment at a temperature between 300° and 590° F. in a non-oxidizing atmosphere under autogenous pressure.

2. The process of claim 1 in which the non-oxidizing atmosphere comprises nitrogen.

3. The process of claim 1 in which the non-oxidizing atmosphere comprises hydrogen.

4. The process of claim 1 in which the low rank solid fuel is sub-bituminous coal.

5. The process of claim 1 in which the low rank solid fuel is lignite.

6. The process of claim 1 in which the separation is made by means of a water suspension of an organic compound.

7. The process of claim 1 in which the separation is made by means of a water suspension of an inorganic compound.

8. The process of claim 7 in which the inorganic compound is magnetite.

9. The process of claim 8 in which the density of the suspension is between 1.35 and 1.45 and is determined from the equation.

$$D = \frac{100}{(100 - C)\frac{C}{d}}$$

Where

D = density of the suspension (g/cc)

d = density of the solids (g/cc)

and

C = concentration of solids (wt. %).

* * * * *